US008439353B2

(12) United States Patent
Tamehira et al.

(10) Patent No.: US 8,439,353 B2
(45) Date of Patent: May 14, 2013

(54) SHEET FEEDING DEVICE AND IMAGE FORMING APPARATUS

(75) Inventors: Masato Tamehira, Osaka (JP); Yoshinori Shiraishi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 240 days.

(21) Appl. No.: 12/728,483

(22) Filed: Mar. 22, 2010

(65) Prior Publication Data

US 2010/0264576 A1 Oct. 21, 2010

(30) Foreign Application Priority Data

Apr. 15, 2009 (JP) ..... 2009-098883

(51) Int. Cl.
*B65H 3/52* (2006.01)

(52) U.S. Cl.
USPC ..... 271/121; 271/145

(58) Field of Classification Search ..... 271/121, 271/122, 124, 125, 114, 117, 118, 109, 273, 271/137, 138, 167, 145; 384/418, 419, 546; 492/15, 492/47, 18; 399/361, 381, 388, 391–393
See application file for complete search history.

(56) References Cited

U.S. PATENT DOCUMENTS

2004/0256787 A1* 12/2004 Wada et al. ..... 271/109

FOREIGN PATENT DOCUMENTS

| | | | |
|---|---|---|---|
| JP | 63-319173 | * | 12/1988 |
| JP | 2-52775 | * | 2/1990 |
| JP | 08-244999 | A | 9/1996 |
| JP | 2001-002255 | A | 1/2001 |
| JP | 2004-352461 | * | 12/2004 |
| JP | 2005-145705 | A | 6/2005 |

* cited by examiner

*Primary Examiner* — Thomas Morrison
(74) *Attorney, Agent, or Firm* — Renner, Otto, Boisselle & Sklar, LLP

(57) ABSTRACT

A sheet feeding device according to this invention includes a bearing support member and a lever member. The bearing support member is supported in the sheet feeding device for movement between a sheet feeding position and a separated position. The lever member is pivotally movable about a bearing portion between a first position which causes the bearing support member to be positioned in the sheet feeding position while causing the bearing portion to be supported by the bearing support member, a second position which causes the bearing support member to be positioned in the separated position while causing the bearing portion to be supported by the bearing support member and a third position which causes the bearing support member to be positioned in the separated position while allowing the bearing portion to be detached from the bearing support member.

16 Claims, 9 Drawing Sheets

SHEET FEEDING DEVICE AND IMAGE FORMING APPARATUS

CROSS REFERENCE

This Nonprovisional application claims priority under 35 U.S.C. §119(a) on Patent Application No. 2009-98883 filed in Japan on Apr. 15, 2009, the entire contents of which are hereby incorporated by reference.

BACKGROUND OF THE INVENTION

The present invention relates to a sheet feeding device for feeding sheets one by one, as well as an image forming apparatus provided with such a sheet feeding device.

DESCRIPTION OF THE RELATED ART

When a paper jam occurs in a sheet feeding device which feeds sheets one by one, the jammed sheet is caught on a sheet feed roller. In such a case, the user usually withdraws the jammed sheet forcibly in order to remove the jammed sheet.

However, an overload is imposed on the sheet feed roller in withdrawing the jammed sheet, thus causing the sheet feed roller to be worn away.

In attempt to overcome such a problem, a sheet feeding device has been disclosed which is provided with an arrangement having a sheet feed roller supported via a torque limiter for preventing an overload from being imposed on the sheet feed roller in withdrawing a jammed sheet (see Japanese Patent Laid-Open Publication No. 2001-002255).

A sheet feeding device of another type has been proposed which allows its sheet feeding unit to be bodily removed in eliminating a paper jam.

The sheet feeding device disclosed in the above-noted Patent Publication, however, has a difficulty in removing a sheet feeding unit including the sheet feed roller because the sheet feeding unit is fixed to the sheet feeding device via a shaft. For this reason, it has been a conventional practice that a service man removes the sheet feeding unit for cleaning or replacement of the sheet feed roller.

Thus, every time the sheet feeding unit is subjected to maintenance such as cleaning or replacement of the sheet feed roller, the user has to call up the serviceman. This results in a poor work efficiency.

With the aforementioned sheet feeding device which allows the sheet feeding unit to be bodily removed in eliminating a paper jam, the sheet feeding unit has to be removed at every occurrence of paper jam. This results in a poor work efficiency in eliminating the paper jam.

In view of these problems, a feature of the present invention is to provide a sheet feeding device which makes it easy to eliminate a paper jam and remove the sheet feeding unit.

SUMMARY OF THE INVENTION

A sheet feeding device according to the present invention includes a sheet feed roller, a drive shaft, a lever member, and a bearing support member. The sheet feed roller feeds sheets one by one. The drive shaft supports the sheet feed roller. The lever member has a bearing portion supporting the drive shaft. The bearing support member is capable of supporting the bearing portion. The bearing support member is supported in a sheet feeding device body for movement between a sheet feeding position which causes the drive shaft to be positioned for the sheet feed roller to exert a sheet feeding pressure on a sheet and a separated position which causes the drive shaft to be positioned for the sheet feed roller to fail to exert the sheet feeding pressure on the sheet. The lever member is pivotally movable about the bearing portion between a first position which causes the bearing support member to be positioned in the sheet feeding position while causing the bearing portion to be supported by the bearing support member, a second position which causes the bearing support member to be positioned in the separated position while causing the bearing portion to be supported by the bearing support member and a third position which causes the bearing support member to be positioned in the separated position while allowing the bearing portion to be detached from the bearing support member.

With this construction, the bearing support member can be displaced by pivotally moving the lever member. As a result, the drive shaft and the sheet feed roller are displaced. This means that the sheet feeding pressure exerted by the sheet feed roller can be varied by merely moving the lever member pivotally.

The lever member is pivotally movable between the three positions, corresponding to which the sheet feed roller can assume three positions. When the lever member is in the first position, the sheet feed roller exerts the sheet feeding pressure on the sheet and hence can feed the sheet. When the lever member is in the second position, the sheet feed roller is separated from the sheet feeding device body and hence fails to exert the sheet feeding pressure, thus allowing a jammed sheet to be eliminated easily. When the lever member is in the third position, the sheet feed roller can be removed from the sheet feeding device body, thus allowing its maintenance, such as cleaning or replacement, to be performed easily.

Since the sheet feed roller can assume a position for elimination of a paper jam in addition to a normal operating position and a position for maintenance, the construction described above allows elimination of a paper jam and removal of the sheet feeding unit to be achieved easily.

The foregoing and other features and attendant advantages of the present invention will become more apparent from the reading of the following detailed description of the invention in conjunction with the accompanying drawings.

DETAILED DESCRIPTION OF THE INVENTION

Hereinafter, a sheet feeding device according to an embodiment of the present invention will be described in detail with reference to the drawings.

Figure 1:
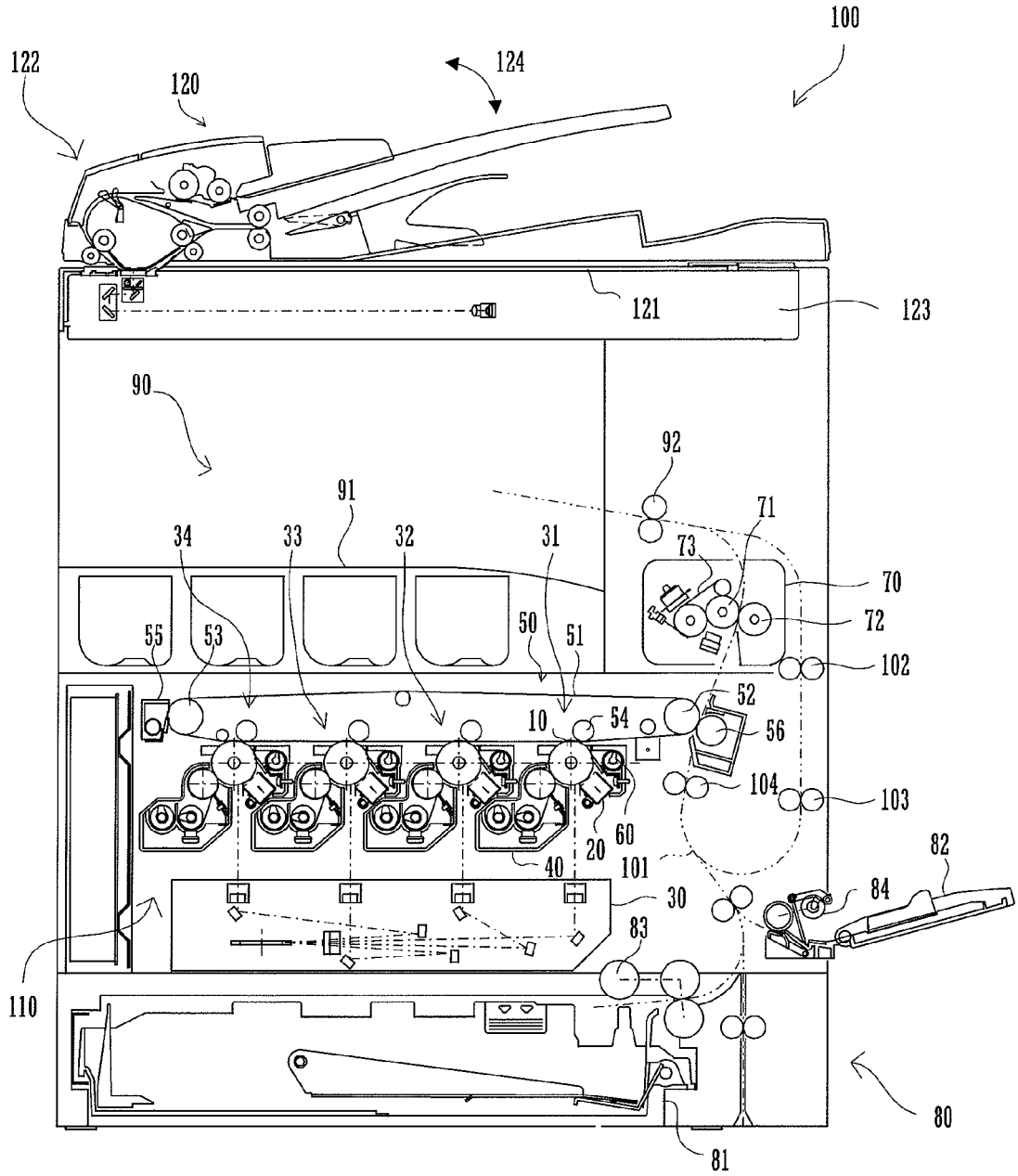
FIG. 1 is a view illustrating a configuration of an image forming apparatus provided with a sheet feeding device according to an embodiment of the present invention.

FIG. 1 is a view illustrating a configuration of an image forming apparatus provided with the sheet feeding device according to the embodiment of the present invention.

An image forming apparatus 100 is configured to form a polychrome or monochrome image on a predetermined sheet (i.e., recording sheet) in accordance with image data transmitted thereto from the outside. The image forming apparatus 100 includes a sheet feeding device 200, a paper feeding section 80, an image forming section 110, and a paper delivery section 90.

The sheet feeding device 200 includes a document platen 121, a document feeding device 122, and a document reading section 123. The document platen 121 is formed of transparent glass and is designed to allow a document to be placed thereon. The document feeding device 122 feeds document sheets placed on a document tray one by one. The document feeding device 122, which is capable of pivoting in a direction indicated by arrow 124, allows the document to be placed on the document platen 121 by exposing the top surface of the document platen 121 to the outside. The document reading section 123 reads a document sheet being fed by the document feeding device 121 or the document placed on the document platen 122.

The paper feeding section 80 includes a paper feed cassette 81, a manual feed cassette 82, and pickup rollers 83 and 84. The paper feed cassette 81 is a tray for holding standard size paper sheets thereon. The manual feed cassette 82 is a tray capable of receiving non-standard size paper sheets thereon. The pickup roller 83, which is located adjacent an end portion of the paper feed cassette 81, picks up paper sheets one by one from the paper feed cassette 81 to feed each paper sheet into a paper feed path 101. Likewise, the pickup roller 84, which is located adjacent an end portion of the manual feed cassette 82, picks up paper sheets one by one from the manual feed cassette 82 to feed each paper sheet into the paper feed path 101.

The image forming section 110 includes a photosensitive drum 10, an electrostatic charger device 20, an exposure unit 30, a developing device 40, an intermediate transfer belt unit 50, a cleaner unit 60, and a fixing unit 70. The photosensitive drum 10 rotates during image formation to carry a developer image thereon. Around the photosensitive drum 10, there are disposed the electrostatic charger device 20, exposure unit 30, developing device 40, intermediate transfer belt unit 50 and cleaner unit 60 in this order from an upstream side in the direction of rotation of the photosensitive drum 10. The fixing unit 70 is provided on the paper feed path 101 at a location most downstream in the image forming section 110.

Image data items used in the image forming apparatus 100 each correspond to a respective one of color images formed using respective colors, i.e., black (K), cyan (C), magenta (M) and yellow (Y). Therefore, four image stations, each of which comprises a set of photosensitive drum 10, electrostatic charger device 20, developing device 40 and cleaner unit 60, are provided for forming four types of image each corresponding to a respective one of black, cyan, magenta and yellow. In the present embodiment, description is directed to one of the image stations.

The electrostatic charger device 20 is means for electrostatically charging a peripheral surface of the photosensitive drum 10 to a predetermined potential uniformly. Besides the charger type as shown in FIG. 1, a contact-type electrostatic charger device using a roller or a brush may be used.

The exposure unit 30 has the function of exposing the photosensitive drum 10 in an electrostatically charged state to light according to image data inputted, thereby forming an electrostatic latent image according to the image data on the peripheral surface of the photosensitive drum 10. The exposure unit 30 is constructed as a laser scanning unit (LSU) including a laser emitting section, a reflecting mirror and the like. In the exposure unit 30, there are disposed a polygon mirror for laser beam scanning and optical components, such as a lens and a mirror, for directing laser light reflected by the polygon mirror to the photosensitive drum 10. The exposure unit 30 may employ a technique using a writing head having an array of light-emitting devices of other type such as ELs or LEDs for example.

The developing device 40 is configured to visualize an electrostatic latent image formed on the photosensitive drum 10.

The intermediate transfer belt unit 50 includes an intermediate transfer belt 51, an intermediate transfer belt driving roller 52, an intermediate transfer belt driven roller 53, an intermediate transfer roller 54, and an intermediate transfer belt cleaning unit 55.

The intermediate transfer belt driving roller 52, intermediate transfer belt driven roller 53 and intermediate transfer roller 54, about which the intermediate transfer belt 51 is entrained, drive the intermediate transfer belt 51 for rotation. The intermediate transfer roller 54 performs application of a transfer bias for transferring a toner image from the photosensitive drum 10 onto the intermediate transfer belt 51.

The intermediate transfer belt 51 is positioned so as to contact the photosensitive drum 10. The intermediate transfer belt 51 has the function of forming a toner image thereon by transfer of the toner image from the photosensitive drum 10 onto the intermediate transfer belt 51. The intermediate transfer belt 51 is formed into an endless belt by using a film having a thickness of about 100 to about 150 μm for example.

The transfer of the toner image from the photosensitive drum 10 to the intermediate transfer belt 51 is achieved by the intermediate transfer roller 54 in contact with the reverse side of the intermediate transfer belt 51. The intermediate transfer roller 54 is applied with a high transfer bias voltage (i.e., a high voltage having a polarity (+) opposite to the polarity (−) of the toner charged) in order to transfer the toner image. The intermediate transfer roller 54 is a roller comprising a shaft of metal (e.g., stainless steel) having a diameter of 8 to 10 mm as a base, and an electrically conductive elastic material (e.g., EPDM or urethane foam) covering the surface of the shaft. The electrically conductive elastic material enables the intermediate transfer belt 51 to be uniformly applied with the high voltage. While the present embodiment uses a transfer electrode in the form of a roller, it is possible to use a transfer electrode in the form of a brush or the like.

Electrostatic latent images thus visualized on the respective photosensitive drums 10 are transferred onto the intermediate transfer belt 51 so as to be superimposed on one another. Image information obtained by the superimposition of the toner images is moved by rotation of the intermediate transfer belt 51 to a contact position between a paper sheet and the intermediate transfer belt 51 and is then transferred onto the paper sheet by the transfer roller 56 disposed at the contact position.

At that time, the intermediate transfer belt 51 and the transfer roller 56 are pressed against each other at a predetermined nip pressure, while the transfer roller 56 applied with a voltage for transferring the toner to the paper sheet (i.e., a high voltage having a polarity (+) opposite to the polarity (−) of the toner charged). For obtaining the above-described nip pressure steadily, one of the transfer roller 56 and the intermediate transfer belt driving roller 52 comprises a hard material (e.g., metal or the like) and the other comprises a soft material such as an elastic roller (e.g., elastic rubber roller, expanded resin roller, or the like).

Toner thus attached to the intermediate transfer belt 51 by contact between the photosensitive drum 10 and the intermediate transfer belt 51 or residual toner remaining on the intermediate transfer belt 51 without having been transferred onto the paper sheet by the transfer roller 56, is removed and collected by the intermediate transfer belt cleaning unit 55. The intermediate transfer belt cleaning unit 55 includes, for example, a cleaning blade as a cleaning member contacting the intermediate transfer belt 51. The intermediate transfer belt 51 contacted by the cleaning blade is supported by the intermediate transfer belt driven roller 53 from the reverse side thereof.

The cleaner unit 60 removes and collects residual toner remaining on the peripheral surface of the photosensitive drum 10 after the image transfer operation following the developing operation.

The fixing unit 70 includes a heating roller 71 and a pressurizing roller 72 which are configured to rotate while nipping a paper sheet therebetween. The heating roller 71 is controlled by a control section based on signals from a non-illustrated temperature detector so that a predetermined fixing temperature is reached. The heating roller 71 has the function of fusing, mixing and pressure-contacting the toner image transferred to the paper sheet by heat-bonding the toner to the paper sheet cooperatively with the pressurizing roller 71, thereby fixing the toner image onto the paper sheet by heat. An external heating belt 73 is provided for heating the heating roller 71 from the outside.

The paper delivery section 90 has a catch tray 91 and paper delivery rollers 92. The paper sheet having passed through the fixing unit 70 is delivered onto the catch tray 91 by passing between the paper delivery rollers 92. The catch tray 91 is a tray for accumulating paper sheets finished with printing.

In cases where double-side printing is requested, when a paper sheet having been finished with one-side printing as described above and passed through the fixing unit 70 is held between the paper delivery rollers 92 at its trailing edge, the paper delivery rollers 92 rotate backwardly to feed the paper sheet to feed rollers 102 and then to feed rollers 103. Thereafter, the paper sheet is subjected to reverse side printing after having passed between registration rollers 104 and is then delivered onto the catch tray 91.

Figure 2:
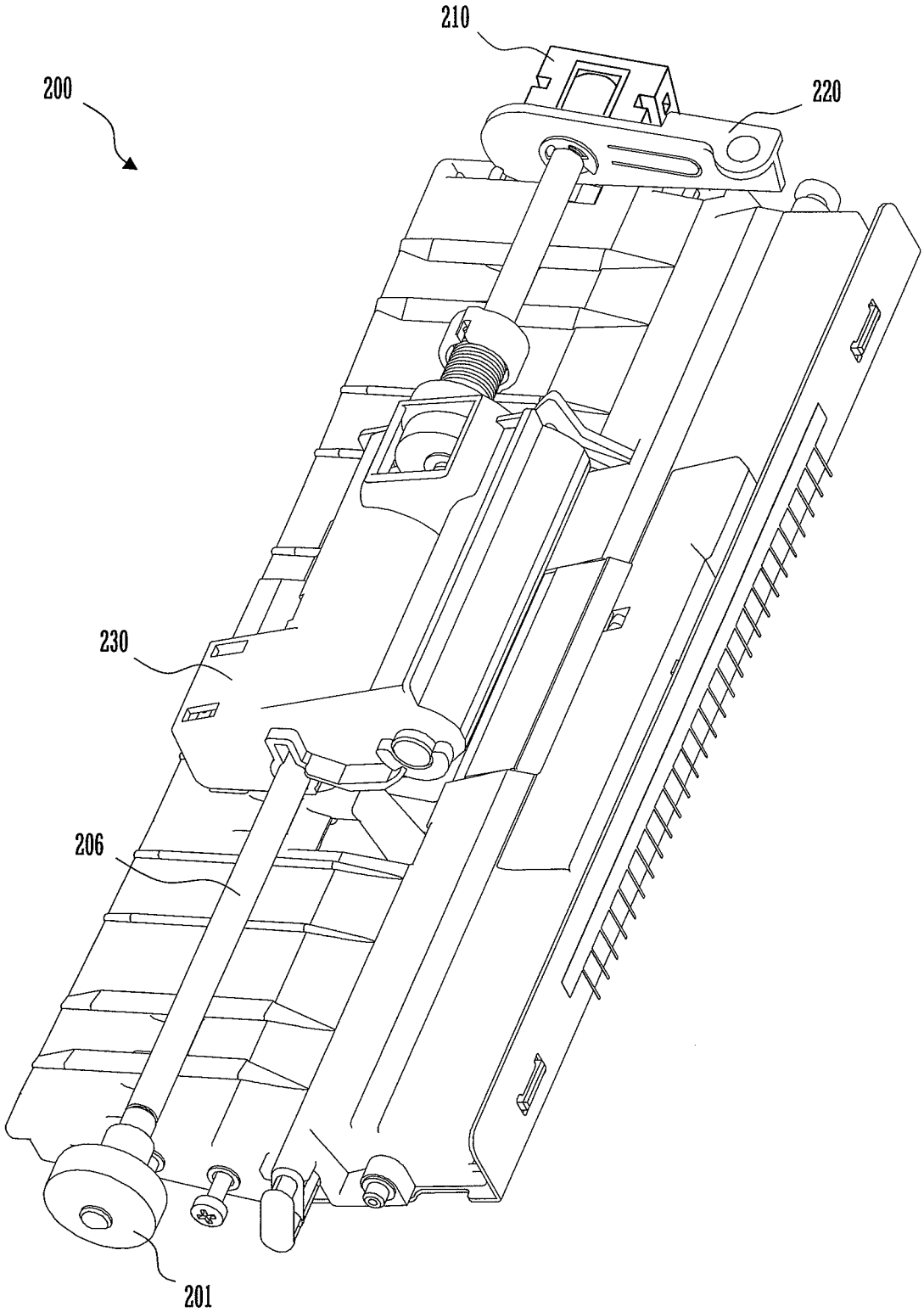
FIG. 2 is a view illustrating a configuration of the sheet feeding device according to the embodiment of the present invention.

FIG. 2 is a view illustrating a configuration of the sheet feeding device according to the embodiment of the present invention.

The sheet feeding device 200 includes a sheet feeding unit 230, a lever member 220, and a bearing support member 210. The sheet feeding unit 230 has a sheet feed roller 204 for feeding sheets one by one. The sheet feed roller 204 is supported on a drive shaft 206. The lever member 220 has a bearing portion 222 which supports one end of the drive shaft 206. The other end of the drive shaft 206 is supported by a driving force transmission gear 201. The bearing support member 210 supports the bearing portion 222 of the lever member 220.

Figure 3:
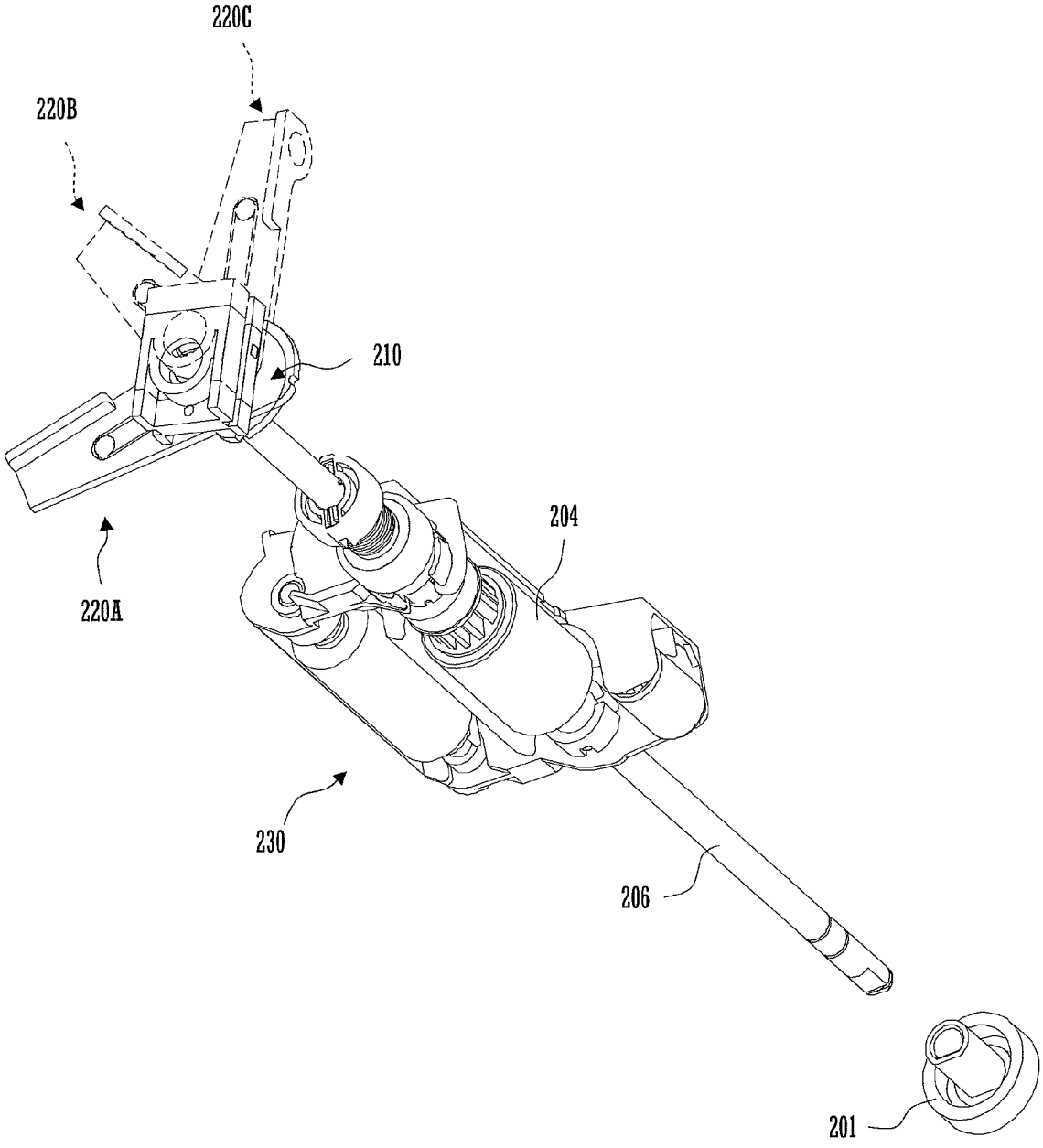
FIG. 3 is a view illustrating positions which a lever w member of the sheet feeding device according to the embodiment of the present invention can assume by its pivotal movement.

FIG. 3 is a view illustrating positions which the lever member of the sheet feeding device according to the embodiment of the present invention can assume by its pivotal movement.

The lever member 220 is pivotally movable within a range defined by a first position 220A, a second position 220B and a third position 220C. By pivotal movement of the lever member 220, the bearing support member 210 is displaced.

With this feature, the bearing support member 210 can be displaced by pivotally moving the lever member 220. As a result, the drive shaft 206 and the sheet feed roller 204 can be displaced. This means that the sheet feeding pressure of the sheet feed roller 204 can be varied by merely moving the lever 220 pivotally.

Figure 4A:
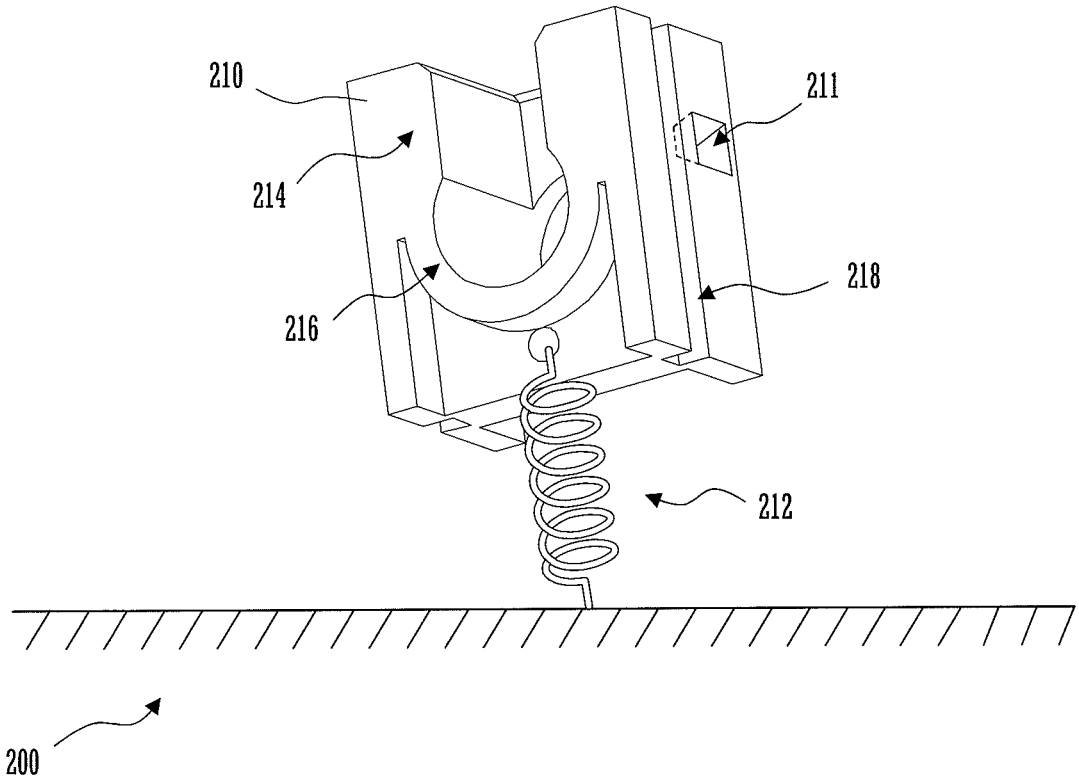
FIG. 4A is a perspective view illustrating the front, right-hand side and bottom of a bearing support member of the sheet feeding device according to the embodiment of the present invention.
Figure 4B:
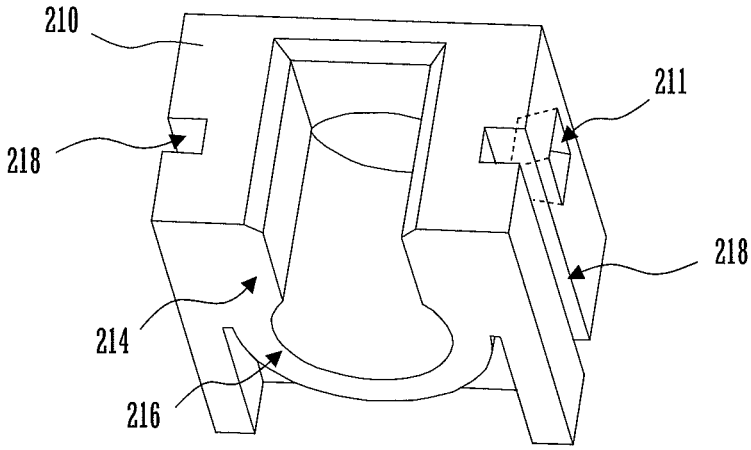
FIG. 4B is a perspective view illustrating the front, right-hand side and top of the bearing support member.
Figure 5A:
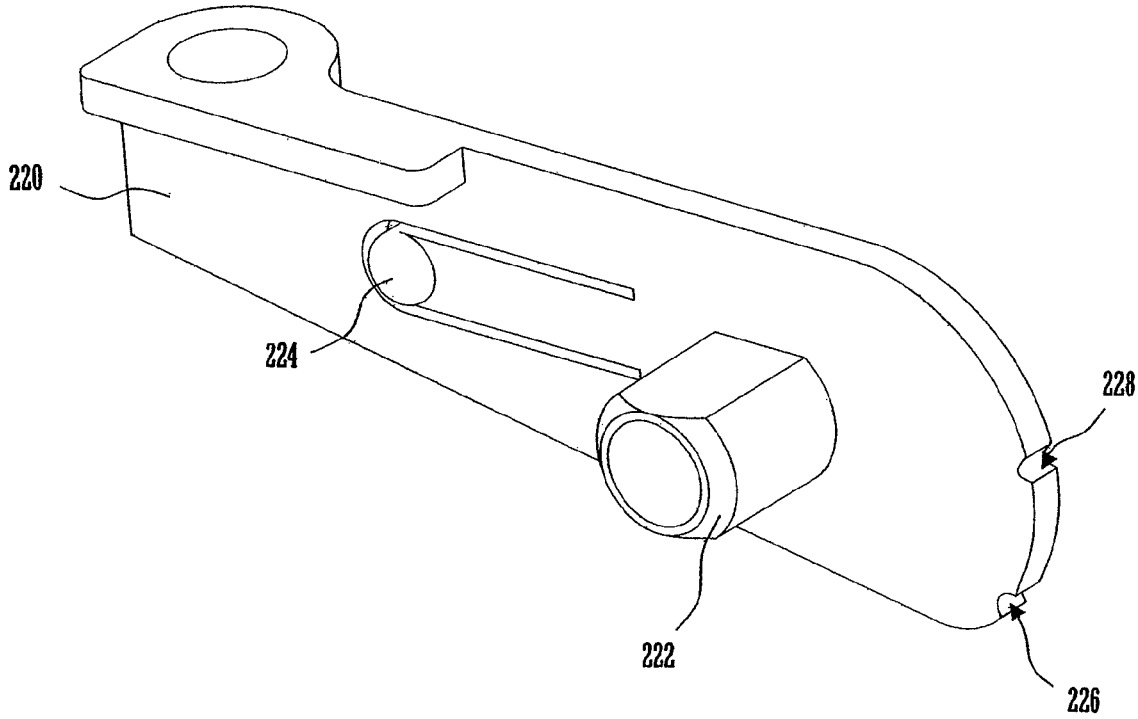
FIG. 5A is a view illustrating a structure of the lever member of the sheet feeding device according to the embodiment of the present invention.
Figure 5B:
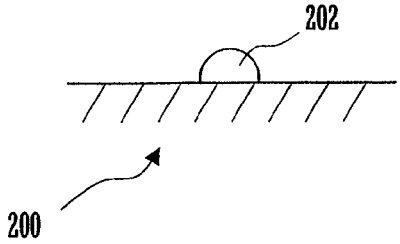
FIG. 5B is a view illustrating an engaged portion provided in the sheet feeding device.

FIG. 4 is a view illustrating a structure of the bearing support member of the sheet feeding device according to the embodiment of the present invention. FIG. 5 is a view illustrating a structure of the lever member of the sheet feeding device according to the embodiment of the present invention and an engaged portion provided in the sheet feeding device.

The bearing support member 210 has a support portion 216, an attachment/detachment passage 214, grooves 218, and a spring 212. The spring 212 is equivalent to the biasing portion defined by the present invention. The lever member 220 has the bearing portion 222, a first engaging portion 224, a second engaging portion 226, and a third engaging portion 228. The second engaging portion 226 is equivalent to the engaging portion defined by the present invention. The sheet feeding device 200 has a first engaged portion 202 and a non-illustrated second engaged portion. The first engaged portion 202 is equivalent to the engaged portion defined by the present invention.

The support portion 216 supports the bearing portion 222. The attachment/detachment passage 214 is narrower than the support portion 216 in a direction vertical to the axial direction of the drive shaft 206. The bearing portion 222 comprises curved surfaces and flat surfaces. The curved surfaces are equivalent to the first pair of outer surfaces defined by the present invention. The flat surfaces are equivalent to the second pair of outer surfaces defined by the present invention. A distance of the curved surfaces between, which can be fitted into the support portion 216, is larger than the width of the attachment/detachment passage 214. A distance of the flat surfaces is narrower than the width of the attachment/detachment passage 214. The bearing portion 222 is supported in such a manner that its curved surfaces are brought into contact with the support portion 216. The bearing portion 222 can be detached from the bearing support member 210 when the flat surfaces are positioned parallel with the attachment/detachment passage 214, but cannot be detached from the bearing support member 210 when the flat surfaces are positioned otherwise. Therefore, such a simple arrangement is capable of preventing the bearing portion 222 from being detached from the bearing support member 210 unless the bearing portion 222 assumes a predetermined position. The bearing support member 210 is movably supported on the sheet w feeding device 200 by means of the grooves 218. For this reason, the bearing support member 210 moves with movement of the bearing portion 222.

The lever member 220 is pivotally movable about the bearing portion 222. A portion of the lever member 220 comes into contact with the sheet feeding device 200 when the lever member 220 moves pivotally. The portion of the lever member 220 which comes into contact with the sheet feeding device 200 comprises a cam portion. The cam portion has a cam shape. Therefore, the bearing support member 210 can be displaced with pivotal movement of the lever member 220 without the need to provide a special mechanism.

The spring 212 biases the bearing support member 210 toward the sheet feeding device 200. This arrangement enables the sheet feed roller 204 to exert the sheet feeding pressure during operation of the sheet feeding device 200 even when the bearing support member 210 is light. Also, the bearing support member 210 can be prevented from coming off from the sheet feeding device 200.

The first engaged portion 202 is shaped convex. The second engaging portion 226 and the third engaging portion 228 are each shaped concave. Therefore, each of the second and third engaging portions 226 and 228 can engage the first engaged portion 202. When the second engaging portion 226 or the third engaging portion 228 engages the first engaged portion 202, the lever member 220 stops pivoting while giving a click-like sensation to the user. Therefore, the user can stop the lever member 220 at a predetermined position accurately. The sheet feeding device 200 is also provided with the second engaged portion shaped concave which is engageable with the first engaging portion 224 shaped convex.

Figure 6A:
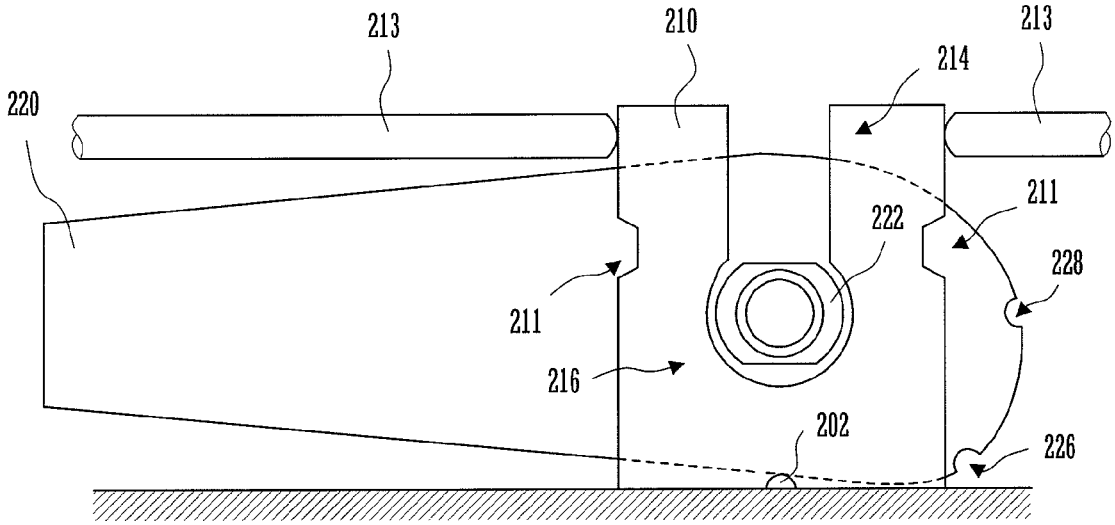
FIG. 6A is a view illustrating the lever member of the sheet feeding device according to the embodiment of the present invention which is in the first position.
Figure 6B:
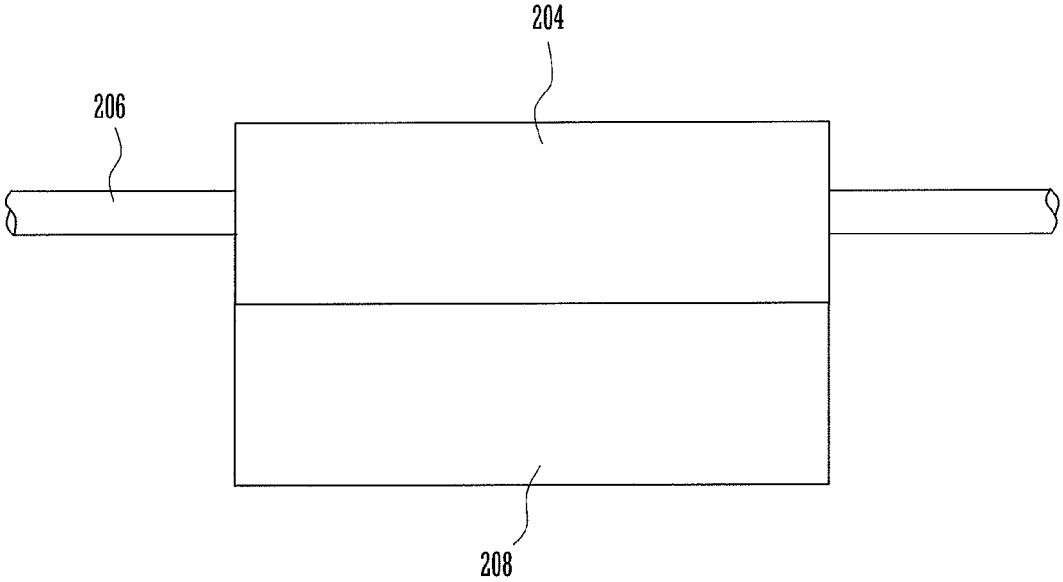
FIG. 6B is a view illustrating a positional relationship between a sheet feed roller and a separating roller which is established when the lever member is in the first position.

FIG. 6 is a view illustrating the lever member 220 in the first position. When the lever member 220 is in the first position, the flat-shaped part of the bearing portion 222 is not parallel with the attachment/detachment passage 214 and, hence, the bearing portion 222 fails to be detached from the bearing support member 210. Further, the bearing portion 222 fails to impose a load which acts to displace the bearing support member 210 when the lever member 220 is in the first position. For this reason, the bearing support member 210 assumes a sheet feeding position which causes the drive shaft 204 to be positioned to bring the sheet feed roller 204 into contact with a separating roller 208 for the sheet feed roller 204 to exert the sheet feeding pressure on a sheet.

Figure 7A:
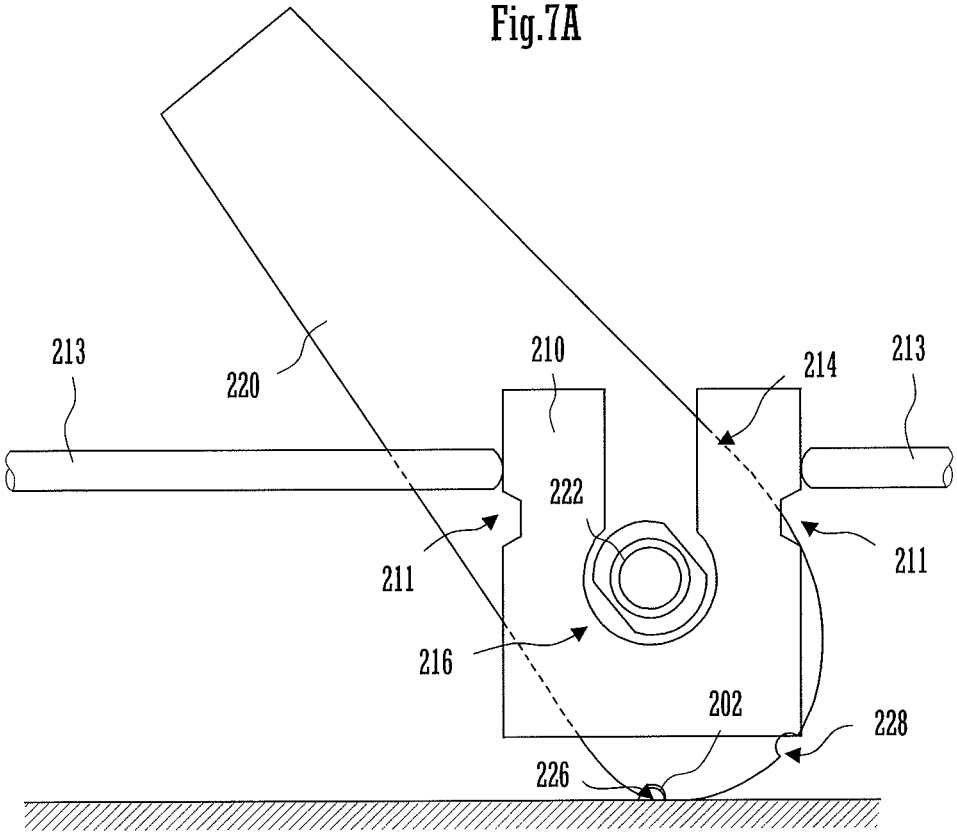
FIG. 7A is a view illustrating the lever member of the sheet feeding device according to the embodiment of the present invention which is in the second position.
Figure 7B:
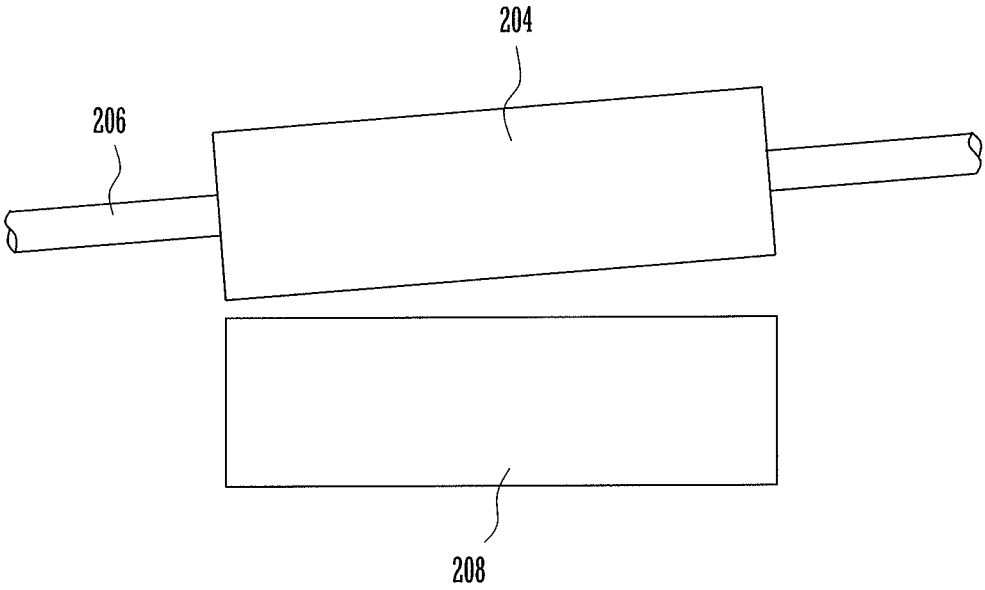
FIG. 7B is a view illustrating a positional relationship between the sheet feed roller and the separating roller which is established when the lever member is in the second position.

FIG. 7 is a view illustrating the lever member 220 in the second position. When the lever member 220 is in the second position, the flat-shaped part of the bearing portion 222 is not parallel with the attachment/detachment passage 214 and, hence, the bearing portion 222 fails to be detached from the bearing support member 210. Further, since the cam portion of the lever member 220 in the second position is in contact with the body of the sheet feeding device 200, the bearing portion 222 imposes a load which acts to displace the bearing support member 210. For this reason, the bearing support member 210 assumes a separated position which causes the drive shaft 204 to be positioned to separate the sheet feed roller 204 from the separating roller 208 for the sheet feed roller 204 to fail to exert the sheet feeding pressure on a sheet.

Figure 8:
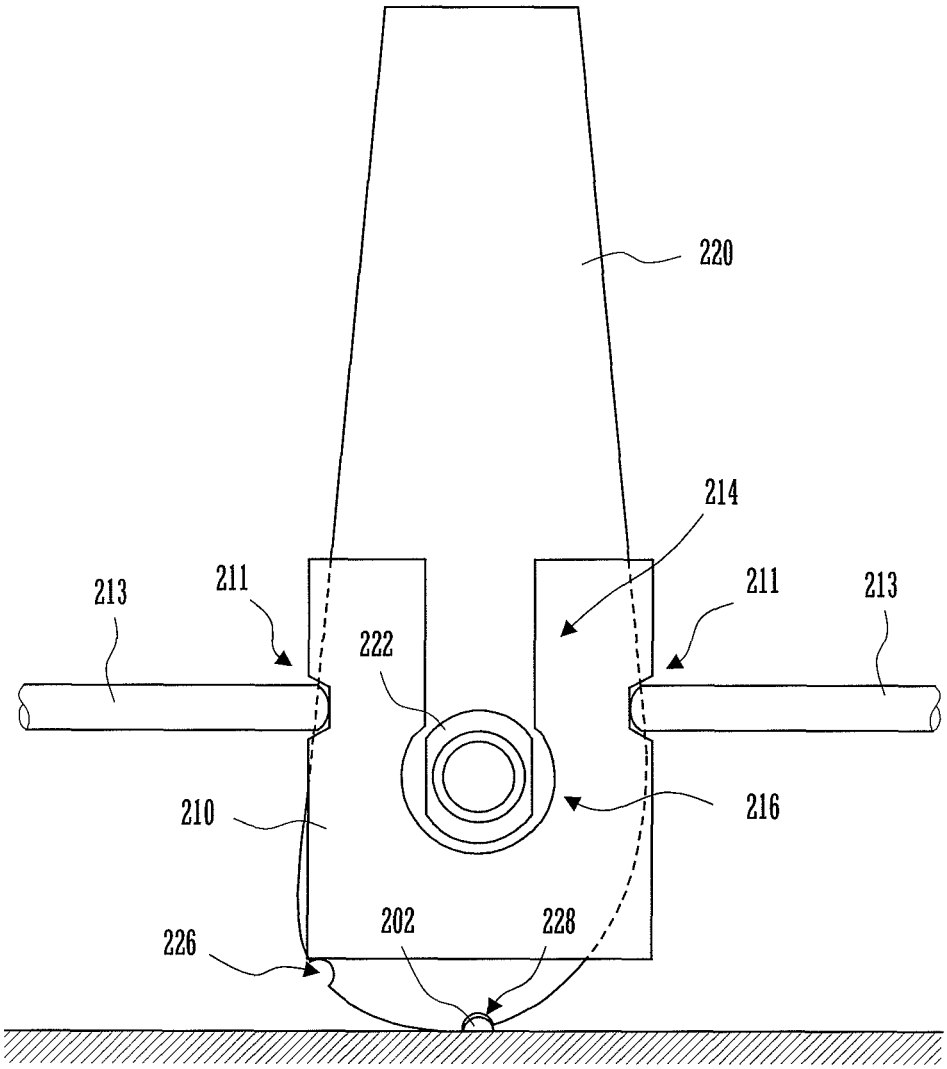
FIG. 8 is a view illustrating the lever member of the sheet feeding device according to the embodiment of the present invention which is in the third position.

FIG. 8 is a view illustrating the lever member 220 in the third position. When the lever member 220 is in the third position, the flat-shaped part of the bearing portion 222 becomes parallel with the attachment/detachment passage 214 and, hence, the bearing portion 222 can be detached from the bearing support member 210. Since the sheet feeding device 200 has a retaining portion 213 for retaining the bearing support member 210, the retaining portion 213 engages a retained portion 211 to retain the bearing support member 210 in the separated position when the lever member 220 is in the third position. The retaining portion 213 has a tip biased toward the bearing support member 210. Therefore, even when the bearing portion 222 is detached from the bearing support member 210 by the lever member 220 assuming the third position, the bearing support member 210 is retained in the separated position by the retaining portion 213. For this reason, the bearing portion 222 can be easily fitted into the bearing support member 210 later. When the lever member 220 is pivotally moved after the bearing portion 222 has been fitted into the bearing support member 210, the retaining portion 213 is released from the retaining state.

As illustrated in FIGS. 6 to 8, the lever member 220 is pivotally movable between the three positions, corresponding to which the sheet feed roller 204 can assume three positions. When the lever member 220 is in the first position, the sheet feed roller 204 is positioned to exert the sheet feeding pressure on a sheet and hence can feed the sheet. When the lever member 220 is in the second position, the sheet feed roller 204 is separated from the sheet feeding device 200 and hence fails to exert the sheet feeding pressure, thus allowing a jammed sheet to removed easily. When the lever member 220 is in the third position, the sheet feed roller 204 is positioned so as to be easily removed from the sheet feeding device 200 and hence can be easily subjected to maintenance such as cleaning or replacement.

Thus, this arrangement enables the sheet feed roller 204 to assume a position for elimination of a paper jam in addition to the normal operating position and the maintenance position, thereby allowing elimination of a paper jam and removal of the sheet feeding unit to be achieved easily.

Figure 9:
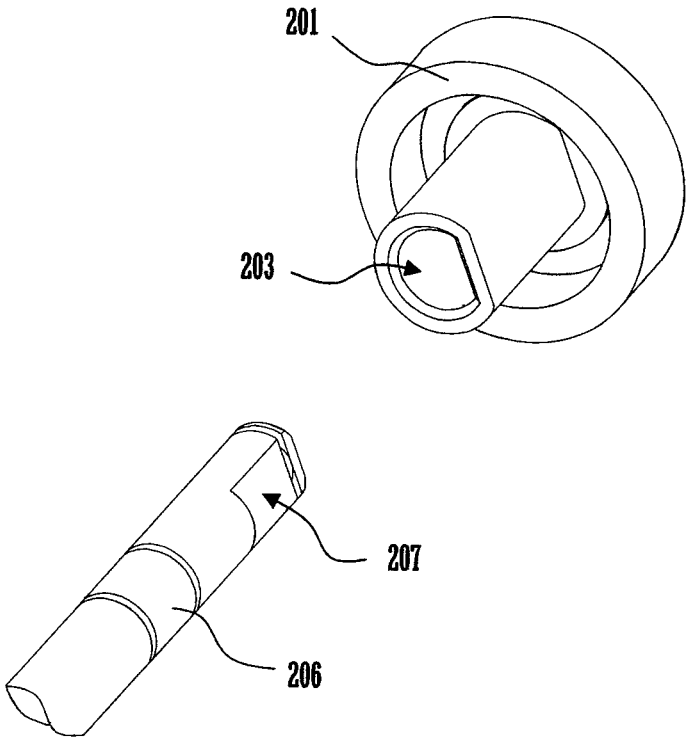
FIG. 9 is a view illustrating the shape of a drive shaft and the shape of a driving force transmitting portion in the sheet feeding device according to the embodiment of the present invention.

FIG. 9 is a view illustrating the shape of one end portion 207 of the drive shaft 206 and the shape of a fitting hole 203 of the driving force transmission gear 201. In the present embodiment, the end portion 207 is partially cut out so as to be D-shaped as viewed in the axial direction. The fitting hole 203 is also D-shaped so as to be fitted over the end portion 207. Each of the end portion 207 and the fitting hole 203 may have any shape other than the D-shape as long as the shape is such that the distance from the center of gravity to a point on the outline thereof as viewed in the axial direction is different from the distance from the center of gravity to another point on the outline.

If the end portion 207 has a circular shape, the fitting hole 203 and the end portion 207 have to be securely fixed to each other in order to rotate the drive shaft 206. Accordingly, the drive shaft 206 cannot be detached from the driving force transmission gear 201. By contrast, the feature described above enable's the drive shaft 206 to rotate without securely fixing the fitting hole 203 and the end portion 207 to each other, thereby making it possible to remove the drive shaft 206 from the sheet feeding device 200 when removing the sheet feed roller 204 from the sheet feeding device 200.

While the foregoing embodiment has been directed to the sheet feeding device 200 applied to a document feeding device, the present invention is not limited to such a document feeding device. The sheet feeding device according to the present invention is applicable to the paper feeding section 80.

The foregoing embodiments are illustrative in all points and should not be construed to limit the present invention. The scope of the present invention is defined not by the foregoing embodiment but by the following claims. Further, the scope of the present invention is intended to include all modifications within the scopes of the claims and within the meanings and scopes of equivalents.

What is claimed is:

1. A sheet feeding device comprising:

a sheet feed roller for feeding sheets one by one;

a drive shaft supporting the sheet feed roller;

a lever member having a bearing portion supporting the drive shaft; and a bearing support member supporting the bearing portion, the bearing support member being supported in a sheet feeding device body for movement between a sheet feeding position which causes the drive shaft to be positioned for the sheet feed roller to exert a sheet feeding pressure on a sheet and a separated position which causes the drive shaft to be positioned for the sheet feed roller to fail to exert the sheet feeding pressure on the sheet, the lever member being pivotally movable about the bearing portion between a first position which causes the bearing support member to be positioned in the sheet feeding position while causing the bearing portion to be supported by the bearing support member, a second position which causes the bearing support member to be positioned in the separated position while causing the bearing portion to be supported by the bearing support member and a third position which causes the bearing support member to be positioned in the separated position while allowing the bearing portion to be detached from the bearing support member, wherein the lever member has a cam portion which comes into contact with the sheet feeding device body when the lever member moves between the first position, the second position and the third position, and the cam portion has a cam shape.

2. The sheet feeding device according to claim 1, wherein the drive shaft has one end portion having a shape such that a distance from a center of gravity to a point on an outline thereof as viewed in an axial direction of the drive shaft is different from a distance from the center of gravity to another point on the outline, the end portion being fitted in a driving force transmitting portion having a hole shaped identical with the end portion.

3. An image forming apparatus comprising:

a sheet feeding device as recited in claim 1; and at least one of an image reading section for reading image data from a sheet fed from the sheet feeding device and an image forming section for forming an image on a sheet fed from the sheet feeding device.

4. The sheet feeding device according to claim 1, wherein the bearing support member has a biasing portion which biases the bearing support member toward the sheet feeding device body.

5. A sheet feeding device comprising:

a sheet feed roller for feeding sheets one by one;

a drive shaft supporting the sheet feed roller;

a lever member having a bearing portion supporting the drive shaft; and a bearing support member supporting the bearing portion, the bearing support member being supported in a sheet feeding device body for movement between a sheet feeding position which causes the drive shaft to be positioned for the sheet feed roller to exert a sheet feeding pressure on a sheet and a separated position which causes the drive shaft to be positioned for the sheet feed roller to fail to exert the sheet feeding pressure on the sheet, the lever member being pivotally movable about the bearing portion between a first position which causes the bearing support member to be positioned in the sheet feeding position while causing the bearing portion to be supported by the bearing support member, a second position which causes the bearing support member to be positioned in the separated position while causing the bearing portion to be supported by the bearing support member and a third position which causes the bearing support member to be positioned in the separated position while allowing the bearing portion to be detached from the bearing support member, wherein the sheet feeding device body has an engaged portion, while the lever member has an engaging portion which engages the engaged portion when the lever member is in the second position.

6. The sheet feeding device according to claim 5, wherein the bearing support member has a biasing portion which biases the bearing support member toward the sheet feeding device body.

7. The sheet feeding device according to claim 5, wherein the drive shaft has one end portion having a shape such that a distance from a center of gravity to a point on an outline thereof as viewed in an axial direction of the drive shaft is different from a distance from the center of gravity to another point on the outline, the end portion being fitted in a driving force transmitting portion having a hole shaped identical with the end portion.

8. An image forming apparatus comprising:

a sheet feeding device as recited in claim 5; and at least one of an image reading section for reading image data from a sheet fed from the sheet feeding device and an image forming section for forming an image on a sheet fed from the sheet feeding device.

9. A sheet feeding device comprising:

a sheet feed roller for feeding sheets one by one;

a drive shaft supporting the sheet feed roller;

a lever member having a bearing portion supporting the drive shaft; and a bearing support member supporting the bearing portion, the bearing support member being supported in a sheet feeding device body for movement between a sheet feeding position which causes the drive shaft to be positioned for the sheet feed roller to exert a sheet feeding pressure on a sheet and a separated position which causes the drive shaft to be positioned for the sheet feed roller to fail to exert the sheet feeding pressure on the sheet, the lever member being pivotally movable about the bearing portion between a first position which causes the bearing support member to be positioned in the sheet feeding position while causing the bearing portion to be supported by the bearing support member, a second position which causes the bearing support member to be positioned in the separated position while causing the bearing portion to be supported by the bearing support member and a third position which causes the bearing support member to be positioned in the separated position while allowing the bearing portion to be detached from the bearing support member, wherein:

the bearing support member has a support portion for supporting the bearing portion and an attachment/detachment passage which is narrower than the support portion in a direction vertical to an axial direction of the drive shaft; and the bearing portion has a first pair of outer surfaces which is configured to be fitted in the support portion and a distance of the first pair between which is larger than a width of the attachment/detachment passage, and a second pair of outer surfaces a distance of the second pair between which is narrower than the width of the attachment/detachment passage and which is positioned parallel with the attachment/detachment passage when the lever member is in the third position.

10. The sheet feeding device according to claim 9, wherein the drive shaft has one end portion having a shape such that a distance from a center of gravity to a point on an outline thereof as viewed in an axial direction of the drive shaft is different from a distance from the center of gravity to another point on the outline, the end portion being fitted in a driving force transmitting portion having a hole shaped identical with the end portion.

11. An image forming apparatus comprising:

a sheet feeding device as recited in claim 9; and at least one of an image reading section for reading image data from a sheet fed from the sheet feeding device and an image forming section for forming an image on a sheet fed from the sheet feeding device.

12. The sheet feeding device according to claim 9, wherein the bearing support member has a biasing portion which biases the bearing support member toward the sheet feeding device body.

13. A sheet feeding device comprising:

a sheet feed roller for feeding sheets one by one;

a drive shaft supporting the sheet feed roller;

a lever member having a bearing portion supporting the drive shaft; and a bearing support member supporting the bearing portion, the bearing support member being supported in a sheet feeding device body for movement between a sheet feeding position which causes the drive shaft to be positioned for the sheet feed roller to exert a sheet feeding pressure on a sheet and a separated position which causes the drive shaft to be positioned for the sheet feed roller to fail to exert the sheet feeding pressure on the sheet, the lever member being pivotally movable about the bearing portion between a first position which causes the bearing support member to be positioned in the sheet feeding position while causing the bearing portion to be supported by the bearing support member, a second position which causes the bearing support member to be positioned in the separated position while causing the bearing portion to be supported by the bearing support member and a third position which causes the bearing support member to be positioned in the separated position while allowing the bearing portion to be detached from the bearing support member, wherein the sheet feeding device body has a retaining portion for retaining the bearing support member, while the bearing support member is retained in the separated position by the retaining portion when the lever member is in the third position.

14. The sheet feeding device according to claim 13, wherein the drive shaft has one end portion having a shape such that a distance from a center of gravity to a point on an outline thereof as viewed in an axial direction of the drive shaft is different from a distance from the center of gravity to another point on the outline, the end portion being fitted in a driving force transmitting portion having a hole shaped identical with the end portion.

15. An image forming apparatus comprising:

a sheet feeding device as recited in claim 13; and at least one of an image reading section for reading image data from a sheet fed from the sheet feeding device and an image forming section for forming an image on a sheet fed from the sheet feeding device.

16. The sheet feeding device according to claim 13, wherein the bearing support member has a biasing portion which biases the bearing support member toward the sheet feeding device body.

* * * * *